US006293032B1

(12) United States Patent
Waits

(10) Patent No.: US 6,293,032 B1
(45) Date of Patent: Sep. 25, 2001

(54) LIGHTED SLIPPER

(76) Inventor: Larry D. Waits, 1747 S. Lake Dr., Lexington, SC (US) 29073

( * ) Notice: Subject to any disclaimer, the term of this patent is extended or adjusted under 35 U.S.C. 154(b) by 0 days.

(21) Appl. No.: 09/567,353

(22) Filed: May 9, 2000

(51) Int. Cl.[7] ..... A43B 23/00
(52) U.S. Cl. ..... 36/137; 36/112; 362/103
(58) Field of Search ..... 36/137, 132, 136, 36/112; 362/103, 190, 191

(56) References Cited

U.S. PATENT DOCUMENTS

| | | | | |
|---|---|---|---|---|
| 4,020,572 | * | 5/1977 | Chiaramonte, Jr. | 36/137 |
| 4,324,054 | | 4/1982 | Rovinsky . | |
| 5,237,760 | | 8/1993 | Altman et al. . | |
| 5,329,432 | | 7/1994 | Bland . | |
| 5,381,615 | | 1/1995 | MacMillan . | |
| 5,473,518 | | 12/1995 | Harber et al. . | |
| 5,483,759 | | 1/1996 | Silverman . | |
| 5,673,502 | | 10/1997 | Caterbone . | |
| 5,720,121 | * | 2/1998 | Barker | 36/137 |
| 5,821,858 | | 10/1998 | Stone . | |
| 5,860,727 | | 1/1999 | Chien . | |
| 5,894,686 | * | 4/1999 | Parker et al. | 36/137 |
| 5,930,921 | | 8/1999 | Sorofman et al. . | |

FOREIGN PATENT DOCUMENTS

| | | | | |
|---|---|---|---|---|
| 2263386 | * | 7/1993 | (GB) | 36/137 |

* cited by examiner

*Primary Examiner*—Paul T. Sewell
*Assistant Examiner*—Jila M. Mohandesi
(74) *Attorney, Agent, or Firm*—Dale J. Ream

(57) ABSTRACT

A lighted slipper comprises a slipper body having an exterior surface defining an opening for receiving a foot of a wearer. The lighted slipper further includes a pair of light housings mounted to the exterior surface forward of the foot opening. Each light housing presents a planar top side and an aperture through a front side. A light is forwardly mounted within each light housing and electrically coupled to a battery which is also mounted on the exterior surface and provides an electric current for energizing each light. A switch housing encases the battery and includes a switch for selectively delivering current from the battery to the lights. A shaft is rotatably coupled to a hub within each light housing. A plurality of colored lenses are radially attached to a plate depending from said shaft such that the lenses may selectably be positioned between the light source and the front side aperture.

17 Claims, 5 Drawing Sheets

LIGHTED SLIPPER

BACKGROUND OF THE INVENTION

This invention relates generally to footwear and, more particularly, to lighted slippers which can selectably vary the color of light projected from light housings thereon.

Night lights which plug in to electrical receptacles are commonly used to illuminate dimly lit areas to aid navigation through a home at night. However, a single night light or ones that are significantly spaced apart are insufficient to ensure that a person, particularly a child, will avoid stepping on toys or other items laying on dimly lit areas of the floor.

Shoes having light arrangements and even lighted slippers have been proposed in the prior art, such as the slippers disclosed in U.S. Pat. No. 4,324,054 to Rovinsky. Although assumably effective for their intended purposes, these slippers are only actuated as a child takes steps and do not allow for continuous light projection, if desired. Further, the devices proposed in the prior art do not provide for the selective projection of differently colored light.

Therefore, it is desirable to have lighted slippers which can delectably vary the color of light projected from light housings mounted thereon. Further, it is desirable to have lighted slippers in which the lights are selectively energized according to a switch mechanism. Finally, it is desirable to have lighted slippers in which the light arrangements are configured to resemble a familiar cartoon or movie character.

SUMMARY OF THE INVENTION

A lighted slipper according to the preferred embodiment of the present invention includes a slipper body having a flexible exterior surface defining an opening between front and rear portions for receiving a foot of a wearer, preferably a child. Obviously, it is contemplated that a pair of lighted slippers would be provided together. Each slipper includes a pair of generally spherical light housings mounted to the front portion of the slipper body. Each light housing is hollow, and includes a planar top and a planar front side defining a circular aperture therethrough.

A switch housing is mounted to the front portion of the slipper body forward of and generally between the light housings. The switch housing and light housings are configured and designed to resemble the eyes and nose of a familiar cartoon or movie character. A battery is disposed within the switch housing. A switch electrically coupled to the battery extends through the switch housing for selective regulation of current flow therefrom.

A light is mounted within each light housing and is forwardly directed toward the aperture in the planar side of the housing. Each light is electrically coupled to the battery and projects light through the aperture when energized. A shaft is vertically positioned within each light housing, each shaft being rotatably mounted to a hub therein. An upper end of each shaft is attached to a convex knob or cap member. Each knob is positioned above the planar top of a respective light housing and thereby maintains the generally spherical shape thereof. The knob may be grasped by a user whereby to rotate the shaft. The other end of each shaft extends through the hub and is attached to a circular support plate. Each support plate includes a plurality of brackets depending therefrom and positioned about the peripheral edge thereof. A plurality of colored lenses are held by the brackets and extend vertically beneath the plate. As the plate is rotated by the shaft, a selected lens is positioned between the light and the light housing aperture. Therefore, a selected light color is projected from each light housing when the lights are selectively energized.

Therefore, a general object of this invention is to provide lighted slippers for illuminating the path of a child who is wearing the slippers.

Another object of this invention is to provide lighted slippers, as aforesaid, having eyes and a nose configured to resemble a familiar character.

Still another object of this invention is to provide lighted slippers, as aforesaid, in which a pair of lights can be selectively energized with a switch positioned in the nose component.

A further object of this invention is to provide lighted slippers, as aforesaid, in which lenses of different colors are rotatably positioned within the light housings for varying the color of light projected therefrom.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

A lighted slipper 10 according to the preferred embodiment of the present invention will now be described with reference to FIGS. 1 through 5 of the accompanying drawings. It should be understood that while the present invention includes a pair of lighted slippers, the drawings and description below will be directed to a single lighted slipper, the second slipper being constructed in a substantially similar manner.

Figure 4:
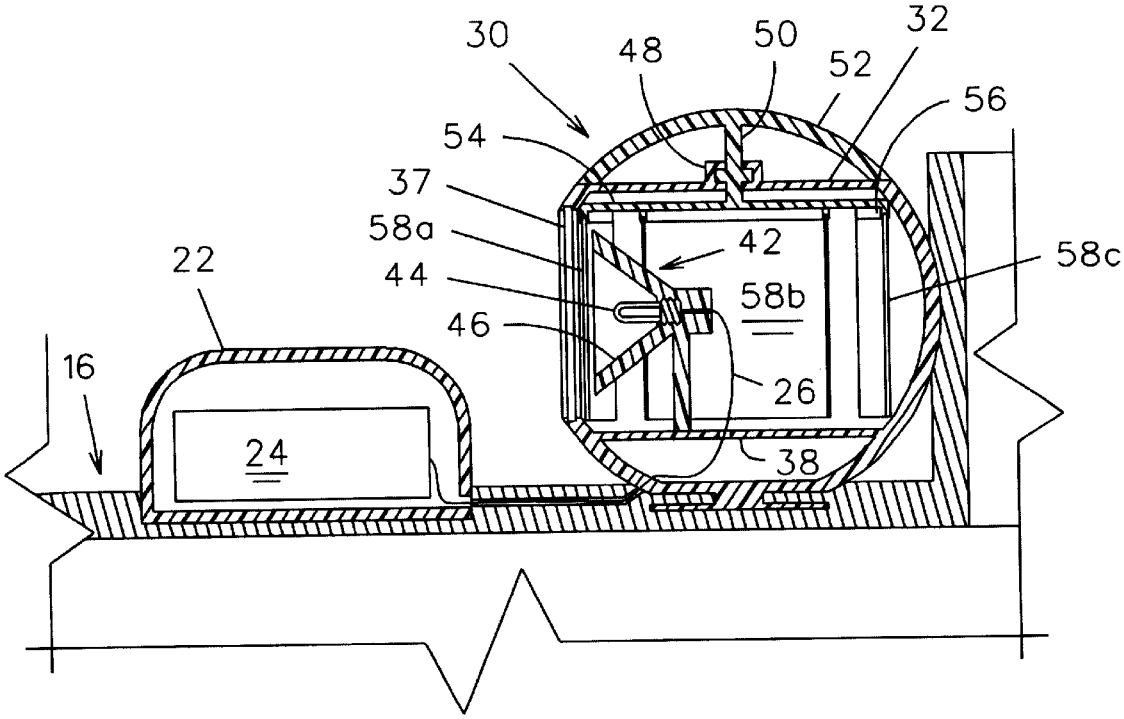
FIG. 4 is a sectional view of the lighted slipper taken along line 4—4 of FIG. 3.
Figure 5:
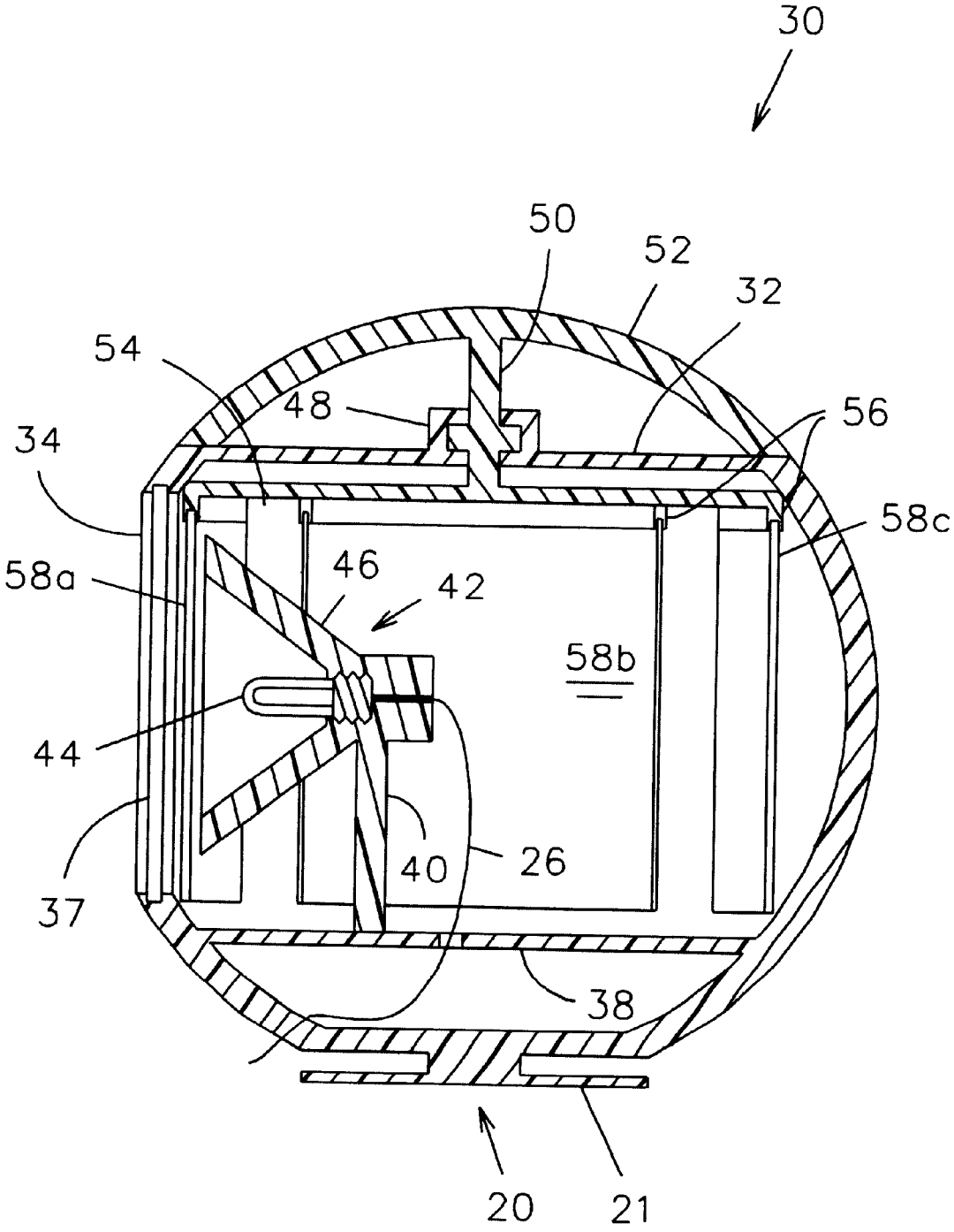
FIG. 5 is a section view on an enlarged scale of the light housing as in FIG. 4.

The lighted slipper 10 includes a slipper body 12 having an exterior surface constructed of a soft, flexible material and defining an opening 14 between front 16 and rear 18 portions for receiving the foot of a child wearer. A pair of generally spherical light housings are mounted to the front portion of the slipper body 12 with retaining grommets 20 (FIGS. 4 and 5). Each grommet 20 includes a neck fixedly attached to a bottom surface of a light housing 30 and a flange 21 suitable for insertion into an opening in the upper surface of the front portion 16 of the slipper body 12. An adhesive such as non-toxic glue may also be used to secure the light housings 30 to the slipper body 12. The light housings 30 are slightly spaced apart in side-to-side relationship and positioned generally above where the metatarsal portion of a wearer's foot would be positioned within the slipper body 12. Each light housing 30 is hollow and, although generally spherical, defines a planar top 32 and front side 34. The front side 34 of each light housing 30 further defines a circular aperture 36 therethrough, the aperture being covered by a transparent lens 37.

Figure 1:
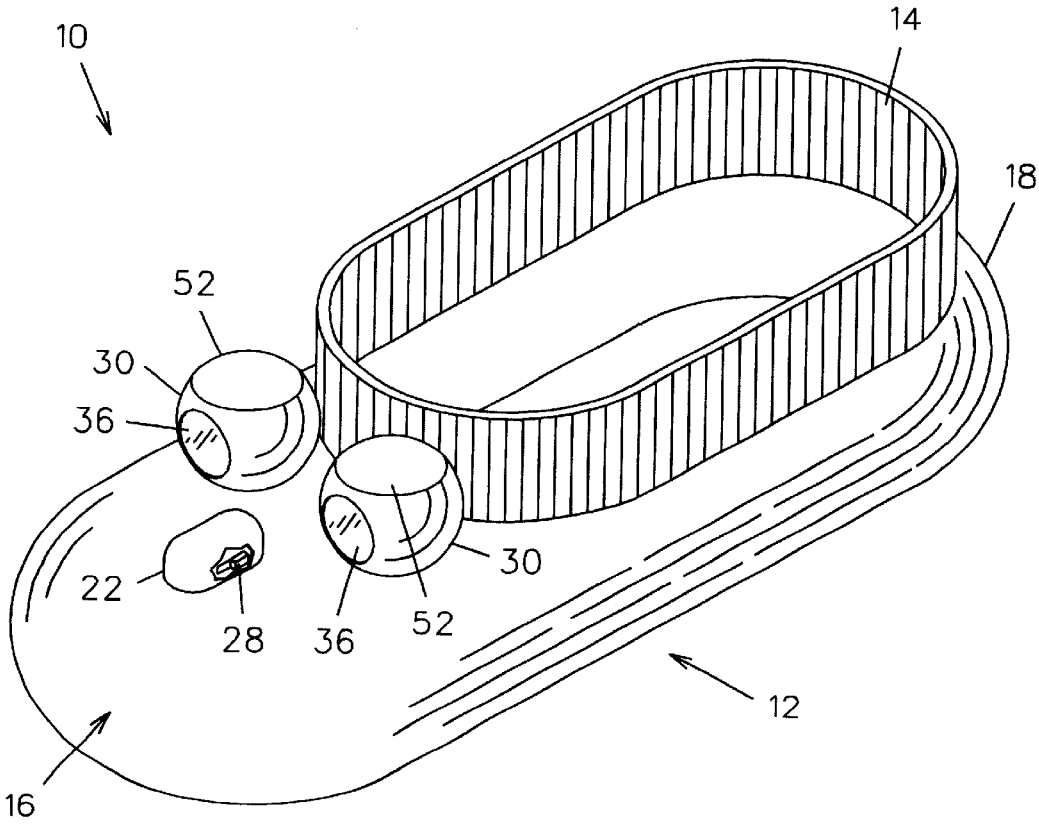
FIG. 1 is a perspective view of a lighted slipper according to the preferred embodiment of the present invention.
Figure 2:
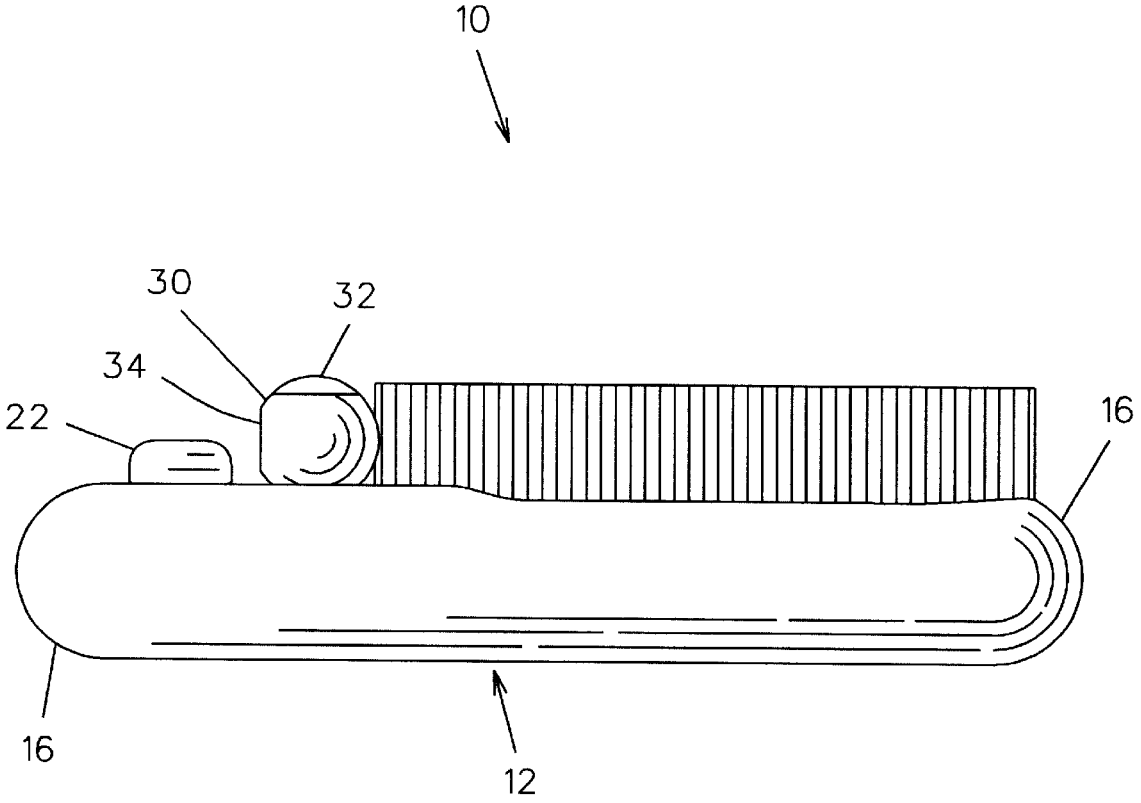
FIG. 2 is a side view of the lighted slipper as in FIG. 1.
Figure 3:
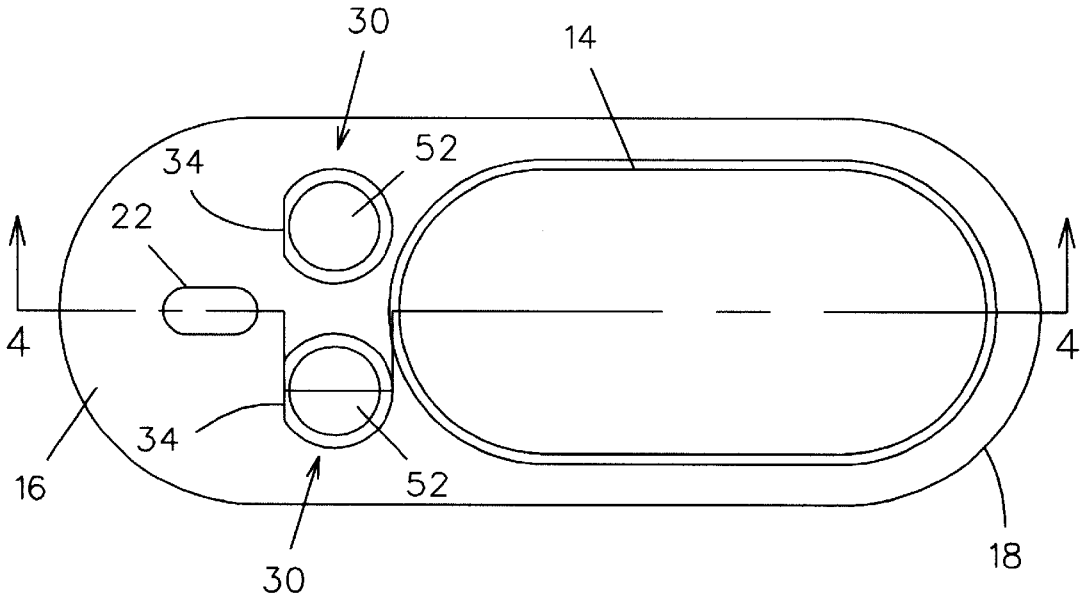
FIG. 3 is a top view of the lighted slipper as in FIG. 1.

A hollow switch housing 22 is mounted to the front portion 16 of the slipper body 12 forward of and generally intermediate the light housings 30 (FIG. 1). The light housings 30 and switch housing 22 are positioned so as to resemble the eyes and nose of a cartoon or movie character familiar to children. Additional cloth elements may also be attached to the slipper to enhance this resemblance. A battery 24 is disposed within the switch housing 22 for providing current to a light, as to be described more fully below. A switch 28 electrically coupled to the battery 24 extends through the switch housing 22 for selectively regulating the flow of electrical current from the battery 24. As shown in FIG. 1, the switch 28 may be a single pole, single throw switch although pressure or spring biased switches are known and would also be suitable. The switch housing 22 is enveloped by a protective material such as neoprene rubber which is flexible enough to allow the switch 28 to be actuated by pressure applied thereto while still protecting the wearer from contact with the battery 24.

Each light housing 30 includes a platform 38 having a post 40 vertically extending therefrom. A light source 42 is mounted to each post 40 and is forwardly directed toward the aperture 36 in the planar front side 34 of the light housing 30. The light source 42 includes an incandescent light bulb 44 and a cone-shaped reflective plate 46 which surrounds the light bulb 44 for directing light through the aperture 36 when the light bulb 44 is energized. The light bulb 44 is electrically coupled to the battery 24 with a wire 26 which extends beneath the surface of the front portion 16 of the slipper body 12.

As best shown in FIG. 5, the planar top 32 of each light housing 30 includes a hub 48. A shaft 50 extends through each planar top 32 and hub 48 and is rotatably coupled to the hub 48 An upper end of each shaft 50 is fixedly attached to a respective convex, disk-like cap member or knob 52. A peripheral edge of each knob 52 is immediately adjacent a peripheral edge of a respective planar top 32 such that the generally spherical configuration of each light housing 30 is maintained. Each knob 52 may be grasped by a wearer of the lighted slipper 10 and rotated so as to rotate the respective shaft. The lower end of each shaft is fixedly attached to a circular support plate 54 within the light housing 30. Each support plate 54 includes a plurality of brackets 56 extending downwardly therefrom and positioned about its peripheral edge. A plurality of colored lenses 58*a*, 58*b*, 58*c* are held by the brackets 56 and extend vertically beneath the plate 54. As the plate is rotated by the shaft 50, a selected lens is positioned between the light bulb 44 and the planar side aperture 36. Accordingly, light corresponding to the color of the selected lens is projected through the aperture 36 when the light bulb 44 is energized Alternatively, a motor could be positioned within each light housing and coupled to the battery 24 for rotating the support plate, either as selected by a user or at predetermined time intervals.

In operation, a child wearer may activate the lighted slippers 10 by appropriately manipulating the switch 28 within the switch housing 22. Bach knob 52 positioned on the top of each light housing 30 causes the support plate 54 within respective housing to rotate for positioning a desired colored lens 58*a*, 58*b*,58*c* between the light bulb 44 and the side aperture 36. Accordingly, light of a corresponding color is projected therethrough to illuminate the path of the wearer. It should be appreciated that each light housing 30 may be individually adjusted to transmit a different colored light.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A lighted slipper, comprising:

a slipper body having an exterior surface defining an opening;

a power source positioned on said exterior surface of said slipper body;

a first light housing coupled to said exterior surface of said slipper body defining an aperture through a front side thereof;

a forwardly directed light source mounted within said first light housing, said light source electrically coupled to said power source for projecting light through said front side aperture when said light source is energized;

switch means positioned on said exterior surface for selectively permitting current from said power source to energize said light source;

a shaft positioned within said first light housing and extending through a top surface thereof;

a plurality of colored lenses rotatably coupled to said shaft and adapted to be selectably positioned between said light source and said front side aperture; and a circular plate mounted to said shaft and having a plurality of radially positioned brackets depending therefrom, said plurality of colored lenses coupled to respective brackets such that a rotation of said shaft causes said colored lenses to be radially rotated within said first light housing.

2. A lighted slipper as in claim 1 wherein said light source is an incandescent light, said lighted slipper further comprising a reflective plate positioned within said first light housing such that light from said incandescent light is reflected through said front side aperture when said incandescent light is energized.

3. A lighted slipper as in claim 1 wherein said power source is a battery.

4. A lighted slipper as in claim 1 further comprising a convex cap member fixedly attached to said shaft, said shaft rotatably coupled to a hub within said first light housing such that a rotation of said cap member causes said shaft to rotate in said hub.

5. A lighted slipper as in claim 1 further comprising:

a second light housing coupled to said exterior surface adjacent said first light housing, said second light housing defining an aperture through a front side thereof;

a forwardly directed light source mounted within said second light housing, said light source electrically coupled to said power source for projecting light through said front side aperture of said second light housing when said light source is energized;

a shaft positioned within said second light housing and extending through a top surface thereof;

a plurality of colored lenses rotatably mounted to said shaft in said second light housing and adapted to be selectably positioned between said light source and said front side aperture of said second light housing.

6. A lighted slipper as in claim 5 further comprising a switch housing mounted on said exterior surface of said slipper body, said power source disposed in said switch housing, said switch housing and said first and second light housings configured so as to resemble a familiar cartoon or movie character.

7. A lighted slipper, comprising:

a slipper body having a front portion connected to a rear portion and defining an opening therebetween for receiving a foot of a wearer;

a battery mounted to said front portion of said slipper body;

a generally spherical first light housing coupled to said front portion of said slipper body and having planar top and front sides, said front side defining an aperture;

a forwardly directed light source mounted within said interior space, said light source electrically coupled to said battery for projecting light through said front side aperture when said light source is energized;

switch means positioned on said front portion of said slipper body adjacent said light housing for selectively permitting current from said battery to energize said light source;

a shaft rotatably mounted to a hub within said interior space and extending upwardly through said top side;

a knob attached to said shaft and positioned adjacent said top side of said housing whereby a rotation of said knob by said wearer causes said shaft to rotate in said hub; and a plurality of colored lenses attached to said shaft and adapted to be selectably positioned between said light source and said front side aperture when said knob is rotated.

8. A lighted slipper as in claim 7 wherein said aperture in said front side is circular.

9. A lighted slipper as in claim 7 wherein said light source is an incandescent light, said lighted slipper further comprising a cone-shaped reflector plate positioned within said first light housing such that light from said incandescent light is reflected through said front side aperture when said incandescent light is energized.

10. A lighted slipper as in claim 7 wherein said knob presents a convex configuration having a radial edge adjacent a radial edge of said top side of said first light housing such that said knob maintains the generally spherical configuration of said first light housing.

11. A lighted slipper as in claim 7 further comprising a circular plate attached to said shaft and having a plurality of radially positioned brackets depending therefrom, said plurality of colored lenses coupled to respective brackets such that a rotation of said knob causes said colored lenses to be radially rotated within said first light housing.

12. A lighted slipper as in claim 7 further comprising:

a second light housing coupled to said front portion of said slipper body adjacent said first light housing and having planar top and front sides, said front side defining an aperture;

a forwardly directed light source mounted within said second light housing, said light source electrically coupled to said battery for projecting light through said front side aperture of said second light housing when said light source is energized;

a shaft positioned within said second light housing and extending through said top side thereof;

a plurality of colored lenses rotatably mounted to said shaft in said second light housing and adapted to be selectably positioned between said light source and said front side aperture of said second light housing.

13. A lighted slipper as in claim 12 further comprising a switch housing mounted on said front portion of said slipper body, said battery disposed in said switch housing, said switch housing and said first and second light housings configured so as to resemble a familiar cartoon or movie character.

14. A lighted slipper, comprising:

a slipper body having an exterior surface defining an opening for receiving a foot of a wearer;

a first light housing mounted to said exterior surface of said slipper body and having planar top and front sides, said front side defining an aperture;

a forwardly directed light source mounted within said first light housing;

a switch housing mounted to said exterior surface adjacent said first light housing and having a switch movable between open and closed positions;

a battery disposed within said switch housing, said battery electrically coupled to said light source for providing an electric current for energizing said light source;

an electrical circuit including said light source and said battery that is closed when said switch is in said closed position for current delivery from said battery to said light source and that is open when said switch is at said open position for precluding current delivery;

a shaft positioned within said first light housing and extending upwardly through said top side;

a plurality of colored lenses rotatably coupled to said shaft and adapted to be selectably positioned between said light source and said front side aperture; and a convex cap member fixedly attached to said shaft and positioned above said top side of said first light housing, said shaft rotatably coupled to a hub within said first light housing such that a rotation of said cap member causes said shaft to rotate in said hub.

15. A lighted slipper as in claim 14 wherein said light source is an incandescent light, said lighted slipper further comprising a reflective plate positioned within said first light housing such that light from said incandescent light is reflected through said front side aperture when said incandescent light is energized.

16. A lighted slipper as in claim 14 further comprising a circular plate mounted to said shaft and having a plurality of radially positioned brackets depending therefrom, said plurality of colored lenses coupled to respective brackets such that a rotation of said shaft causes said colored lenses to be radially rotated within said first light housing.

17. A lighted slipper as in claim 14 further comprising:

a second light housing coupled to said exterior surface adjacent said first light housing and having planar top and front sides, said front side defining an aperture;

a forwardly directed light source mounted within said second light housing, said light source electrically coupled to said power source for projecting light through said front side aperture of said second light housing when said light source is energized;

a shaft positioned within said second light housing and extending upwardly through said top side;

a plurality of colored lenses rotatably mounted to said shaft in said second light housing and adapted to be selectably positioned between said light source and said front side aperture of said second light housing.

* * * * *